United States Patent [19]

Kammeraad

[11] Patent Number: 4,822,061

[45] Date of Patent: Apr. 18, 1989

[54] VALVE SEAL RETAINER

[75] Inventor: James A. Kammeraad, Holland, Mich.

[73] Assignee: K-Line Industries, Inc., Holland, Mich.

[21] Appl. No.: 103,956

[22] Filed: Oct. 2, 1987

[51] Int. Cl.[4] ..... F16J 15/00; F16K 41/00

[52] U.S. Cl. ..... 277/181; 123/188 P

[58] Field of Search ..... 277/181, 183, 188; 123/188 P

[56] References Cited

U.S. PATENT DOCUMENTS

| | | | |
|---|---|---|---|
| 570,726 | 11/1896 | Butts | 277/12 X |
| 1,379,041 | 5/1921 | Pulliam | 82/209 |
| 2,282,312 | 5/1942 | Halstead | 286/26 |
| 2,570,117 | 10/1951 | Hallstrand | 308/36.1 |
| 2,587,405 | 2/1952 | Stevens et al. | 286/5 |
| 2,746,781 | 5/1956 | Jones | 288/2 |
| 2,813,524 | 11/1957 | Brenneke | 123/188 |
| 2,859,993 | 11/1958 | Estey | 288/9 |
| 2,878,799 | 3/1959 | Brenneke | 123/188 |
| 2,906,255 | 9/1959 | Bunce | 123/188 |
| 3,069,175 | 12/1962 | Skinner, Sr. | 277/48 |
| 3,198,188 | 8/1965 | Heid, Jr. | 123/188 |
| 3,531,134 | 9/1970 | Kammeraad | 277/181 |
| 3,599,992 | 8/1971 | Kammeraad | 277/48 |
| 3,829,105 | 8/1974 | Kammeraad | 277/183 |
| 3,884,210 | 5/1975 | Ferch | 123/188 P |
| 3,910,586 | 10/1975 | Todaro | 123/188 P |
| 4,502,696 | 3/1985 | Kammeraad | 277/12 |

FOREIGN PATENT DOCUMENTS

| | | |
|---|---|---|
| 728823 | 4/1955 | United Kingdom . |
| 983024 | 2/1965 | United Kingdom . |

*Primary Examiner*—Donald A. Griffin

*Attorney, Agent, or Firm*—Price, Heneveld, Cooper DeWitt & Litton

[57] ABSTRACT

A retainer for retaining a resilient annular oil seal element, surrounding the valve stem, to the valve guide in an internal combustion engine. The retainer includes an anchor sleeve made from a polymeric material such as nylon, Teflon or the like, first retention means for retaining the sleeve to an outer surface of a valve guide, a tubular shell surrounding the seal element, second retention means for retaining the seal element within the tubular sheet and retention means for retaining the shell to the anchor sleeve. Preferably the first retention means comprises preselecting the diameter of an inner surface of the anchor sleeve for interference fit with the valve guide outer surface.

23 Claims, 2 Drawing Sheets

VALVE SEAL RETAINER

BACKGROUND OF THE INVENTION

The present invention relates to valve seals for valves of internal combustion engines and, more particularly, to a valve seal retainer mechanism.

Internal combustion engines typically have a plurality of reciprocating valves for permitting entry of the combustion mixture into, and exhaust of the combustion products out of, the cylinders. These valves have valve stems which slidably reciprocate within the valve guides bores through the cylinder head of the engine. The valves are actuated in proper sequence by means of rocker arms, push rods, cams and the like, which are well-known in the art.

There typically is provided a bath of oil surrounding the above components to minimize wear during operation of the engine. In particular, it has been found that a certain amount of oil must be allowed to work its way down between the valve stem and valve guides to provide lubrication and prevent excessive wear. However, it is undesirable to permit excessive quantities of oil to work down between the valve stems and guides since the oil will leak into the cylinder causing excessive oil usage by the engine and poor operating characteristics.

Therefore, valve seals are typically provided which meter the amount of oil permitted to pass between the valve stems and the seals. These seals may be stamped from Teflon and are typically positioned around the valve stems immediately above the valve guides. Because Teflon seals cannot be molded to conform to the three-dimensional shape of the end of the valve guides, the flat Teflon seals are held in place by deformable, metallic retaining boots such as those illustrated in U.S. Pat. No. 3,531,134, issued to the present applicant, which secure the seals to the outer wall or shoulder of the valve guides. Such boots are positioned telescopically over the valve guides and deformed to effect frictional engagement therewith.

The engagement between the retaining boots and the outer surface of the valve guides should be tight to withstand the forces exerted by the reciprocating valve stems over a long period of time. It has been found, however, that the retaining boots of the type illustrated in the aforementioned U.S. Pat. No. 3,531,134 may occasionally fail and pull off the valve guide, rendering the seal ineffective.

Because of such potential installation problems, the valve seal retaining boot disclosed in U.S. Pat. No. 3,531,134 has found primary acceptance only in engine rebuilding operations where tolerances are closely controlled. Such boots have not found wide acceptance by engine manufacturers as original equipment because of excessive tolerance problems. This has been the case even though metallic retaining boots of this type, when properly fitted, are superior to other currently available retaining boots.

SUMMARY OF THE INVENTION

A valve seal retainer according to the present invention provides increased retaining force on a valve guide outer surface in comparison to prior art retaining boots. A retainer according to the present invention provides such increased retaining force while accommodating valve guide walls having a wide diameter tolerance range. Accordingly, a valve seal retainer according to the present invention is capable of use by engine manufacturers with original equipment engines notwithstanding the dimension tolerance problem associated with such engines.

A valve seal retainer according to the present invention includes a sleeve generally surrounding the valve guide, first retention means for retaining the sleeve to an outer surface of the valve guide, a generally tubular shell, second retention means for retaining the seal element within the shell and third retention means for retaining the shell to the sleeve.

These and other objects, advantages and features of the present invention will be more fully understood and appreciated with reference to the written specification and appended drawings.

DESCRIPTION OF THE PREFERRED EMBODIMENT

Figure 1:
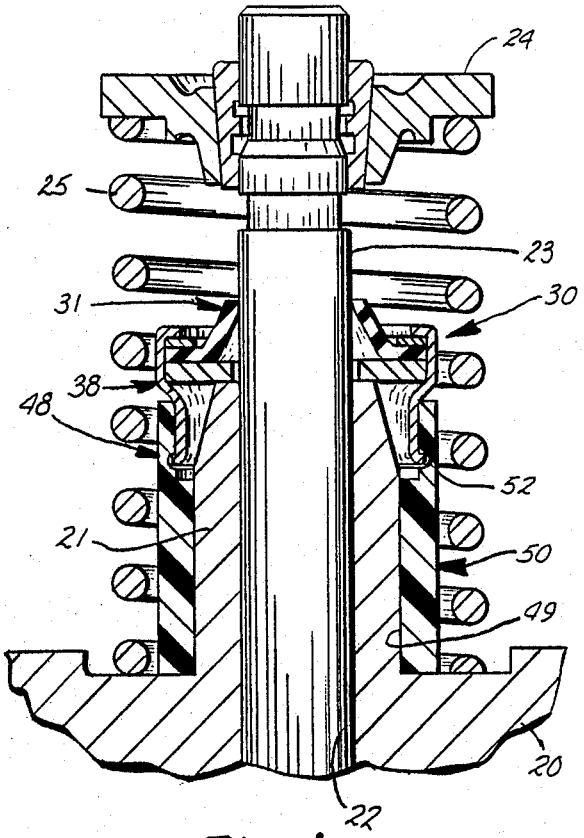
FIG. 1 is a central sectional elevational view of a valve assembly including a valve seal retainer according to the present invention.

A representative overhead valve engine head 20 has a valve guide 21 formed therein as illustrated in FIG. 1. Valve guide 21 has a central opening 22 to reciprocatingly receive a valve stem 23. The top of the valve stem mounts a cap or plate 24 through which the upper end of the stem projects for engagement with a conventional rocker arm (not illustrated). Surrounding valve stem 23 and compressed between the cap 24 and the engine head 20 is a spring 25. All of the preceding structure is conventional.

Adjacent the upper end of the valve guide 21, surrounding the valve stem and located within the spring 25 is a valve seal assembly generally shown at 30. Valve seal assembly 30 includes a resilient annular seal element 31, a generally tubular boot or shell 38 surrounding element 31, retention means generally shown at 36 for retaining the seal element within the tubular shell, an anchor sleeve 50 surrounding and frictionally engaging the outer wall surface of the valve guide, and retention means generally shown at 48 for retaining the shell in engagement with sleeve 50.

Figure 2:
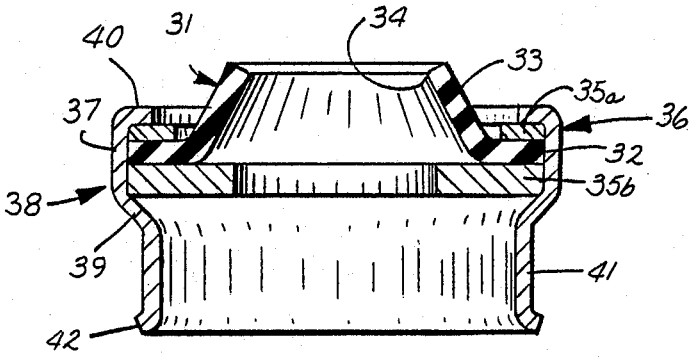
FIG. 2 is a sectional elevational view along the same plane as FIG. 1 illustrating the seal element and retainer in FIG. 1 assembled together without a mounting sleeve.

Annular seal element 31 has a flat peripheral portion 32 and a frusto-conical inner portion 33 inclined upwardly and inwardly toward the valve stem (FIG. 2). The upper edge of inner portion 33 terminates in a lip edge 34 which seats about and resiliently presses against the valve stem to act as a lubricant wiper. The seal element is made of a flexible, resilient material which is stable and not adversely affected by oil, gasoline, diesel fuel or similar hydrocarbons and also is capable of withstanding the high operating temperatures transmitted to it through both the valve stem 23 and guide 21. The selection of a material suitable for this purpose is within the knowledge of one skilled in the art to which this invention applies. The thickness of the seal element, its stiffness and the precise diameter of the opening through which the valve stem reciprocates should be such that the wiping action of the lip of the seal element will remove most of the lubricant applied to it while exposed in the valve chamber but will allow a very thin film to pass through, sufficient to lubricate the stem as it reciprocates in valve guide 21. Selection of these parameters is also within the knowledge of one skilled in the art to which this invention applies.

Peripheral portion 32 of seal element 31 is clamped between a relatively thin metallic upper washer 35*a* and a thicker metallic lower washer 35*b*. Washers 35*a* and 35*b*, with peripheral portion 32 of element 31 pressed between them, are tightly clamped within the upper portion 37 of a tubular boot or shell 38, providing retention means generally shown at 36 for retaining the seal element within the shell. The shell 38 is formed from sheet steel and retention means 36 may be provided by the shell wall being pressed or spun tightly around the peripheral edges of the washers and extended radially under lower washer 35*b*, forming a seat 39 beneath it. Retention means 36 further includes the upper edge of shell 38 being rolled over the top of the upper washer 35*a* to form a flange 40 that cooperates with seat 39 to press the washers together to positively clamp and hold the seal element 31. A lower neck portion 41 of the shell 38 has a lower edge that is turned radially outwardly to form a shallow outwardly extending lip 42.

Anchor sleeve 50 has an inner surface including a lower portion 49 and an enlarged upper portion 51 which extends through an upper end thereof. The diameter of the lower surface portion 49 in the embodiment shown in FIG. 1 is preselected to provide an interference fit with the outer surface of valve guide 21 providing retention means for retaining the anchor sleeve to the valve guide. The diameter of upper surface portion 51 is approximately that of the outside diameter of the neck portion 41 of the shell 38. A circumferential channel 52 is formed in upper portion 51 immediately above its lower extent. The purpose of channel 52 is to snap-fit receive and retain outwardly extending lip 42 when the neck of the shell is press fitted into the anchor sleeve. Lip 42 seated in channel 52 forms retaining means 48 for retaining shell 38 to the anchor sleeve 50.

Figure 3:
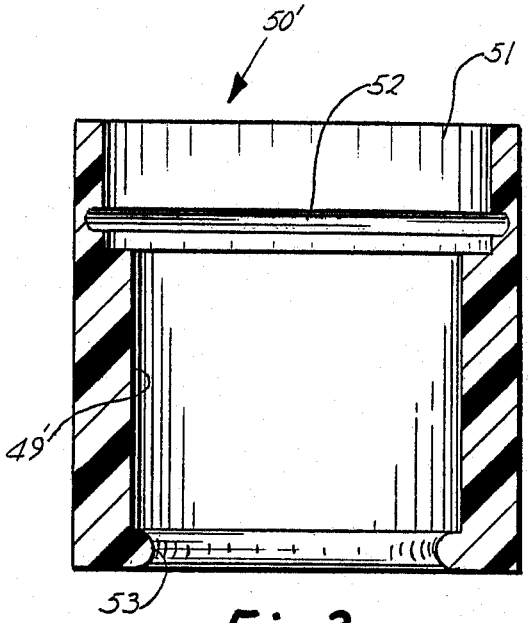
FIG. 3 is a central sectional elevational view of a modification to the mounting sleeve in FIG. 2.

In a known process for renewing the valves and valve guides in an engine, the outer surface of the valve guide is machined to a precise tolerance, eliminating the high friction surface characteristics of an unmachined sand casting. However, this machining may not be routinely performed on production engine heads in the factory. The result is that production engines may include an eccentricity of the valve stem opening with respect to the valve guide outer surface up to 0.010 inches. To accommodate this eccentricity, the anchor sleeve may be modified to that illustrated in FIGS. 3 and 4. In both versions of the modified anchor sleeve, the inside diameter of lower wall portion 49 is increased throughout most of its axial length to provide clearance with the valve guide. To provide retention means for retaining the anchor sleeve to the valve guide, an in-turned bead or lip is provided at the bottom end of the anchor sleeve. In the anchor sleeve 50' illustrated in FIG. 3, this takes the form of an internal bead 53 having a generally semicircular cross section. The inside diameter of bead 53 is selected to provide an opening which will provide an interference fit with the valve guide outer surface but which will not cause the anchor sleeve to take a significant permanent set when the valve seal assembly is installed. Modified anchor sleeve 50' can accommodate a somewhat greater value guide eccentricity tolerance because the bead can, and in fact does, roll slightly upwardly as the sleeve is installed. This roll will permit the sleeve to pass over a somewhat enlarged portion of a valve guide without the material reaching its elastic limit. Thus, the amount of dimensional interference that can be accommodated may exceed the approximate 0.005 inch limit that would likely be imposed on anchor sleeves of the embodiment illustrated in FIG. 1. However, forces acting to remove the anchor sleeve would not only have to overcome the normal grip exerted by the bead but also the additional resistance created by the bead as it is further stretched to roll back to its original shape.

Figure 4:
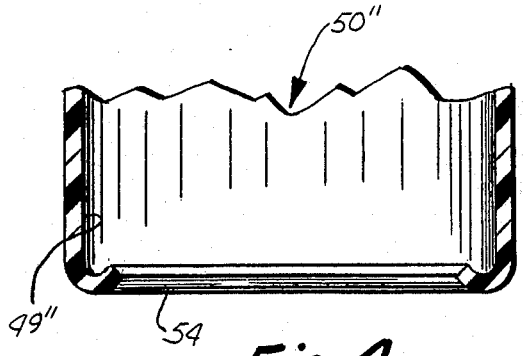
FIG. 4 is a fragmentary central sectional elevational view of a further modification to the mounting sleeve in FIG. 2.

In the anchor sleeve 50'' illustrated in FIG. 4, lower wall portion 49 has an inwardly rolled and upwardly turned bottom lip 54. Because of its thinner wall construction, this lip construction does not have the stiffness, and thus initial resistance to deformation, of the bead 53 in FIG. 3. However, it develops very significant resistance to removal because it is rolled to a greater degree than the bead in FIG. 3 during installation. Both bead 53 and lip 54 facilitate installation by reducing the force necessary to press the sleeve onto the valve guide without reducing the resistance to removal of the sleeve.

Bead 53 and lip 54 need not be at the extreme lowermost portion of the sleeve but may be spaced essentially anywhere along lower surface portion 49 with the same result. Multiple beads or lips vertically spaced in the sleeve, can be utilized to provide enhanced resistance to removal. The individual beads or lips may be made thinner in order to prevent excessive resistance to assembly of the sleeve to the valve guide.

Anchor sleeve 50 is fabricated of a polymeric material capable of maintaining its physical and chemical properties at the temperatures normally encountered in the valve chambers of reciprocating engines, particularly overhead valve engines, while being exposed to lubricating oil and normal automotive hydrocarbon fuels and the additives contained in such fuels.

A preferred material for this purpose is Viton, a fluorocarbon resin, sold by E. I. DuPont de Nemours. Other acceptable materials are natural nylon and virgin Teflon, such as DuPont's commercial quality Teflon. Nylon has the desirable characteristic of being capable of injection molding while Teflon has somewhat superior physical characteristics but can be shaped into the anchor sleeve only by machining, which is a more expensive and hence less desirable procedure.

It has been found that for many applications, the wall thickness of anchor sleeve 50 is preferably approximately 0.060 of an inch. An anchor sleeve made from Viton Rubber having an 0.060 inch wall telescopically press fitted over a typical valve guide 21 of about 0.50 inch diameter will develop a maximum pull resistance when the diameter of the sleeve 50 is stretched approximately from 0.002 to 0.005 of an inch during installation. Stretching the diameter of the anchor sleeve from 0.002 to 0.005 of an inch subjects the sleeve to stress without causing any significant permanent set in the material. A sleeve 50 made alternatively from nylon has an approximate 0.020 inch diametrical stretch limit before it becomes overstretched and takes a significant permanent set.

Figure 5:
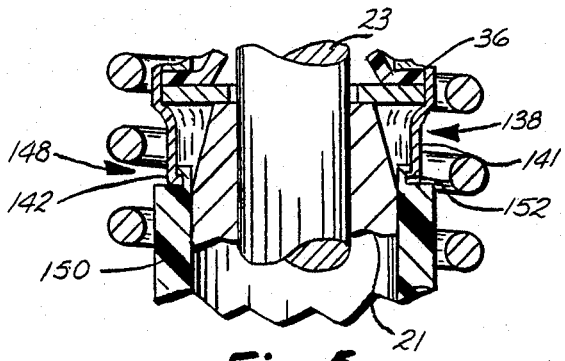
FIG. 5 is a fragmentary sectional elevational view of a valve assembly including a first alternative embodiment of the invention.

FIG. 5 illustrates a first alternative embodiment of the invention in which the retention means 148 for retaining a shell 138 to a sleeve 150 includes an inwardly turned lip 142 on lower neck portion 141 of the shell is engaged with an outwardly facing channel 152 formed in an upper portion of sleeve outer surface 145. This embodiment provides enhanced versatility of application because the portion 141 of the shell is not placed between the upper end portion of the valve guide and the anchor sleeve but rather fits outside of the anchor sleeve.

Figure 6:
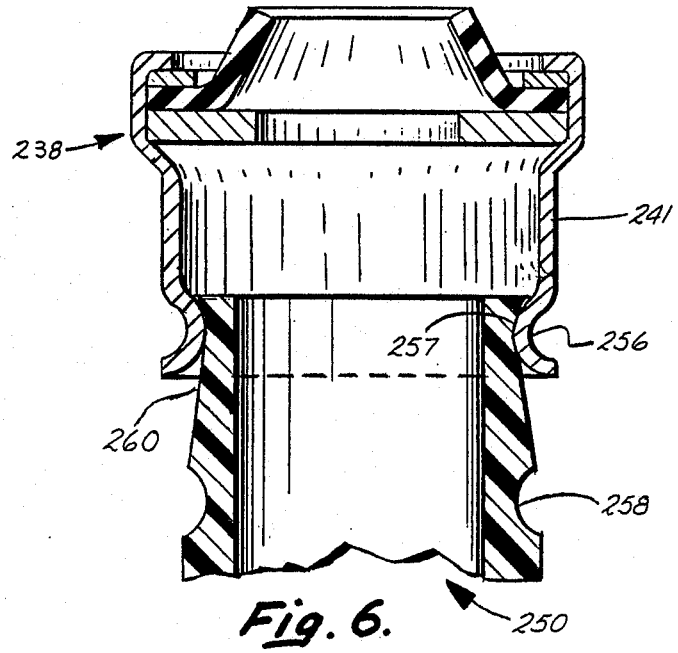
FIG. 6 is a fragmentary sectional elevational view of a valve assembly including a second alternative embodiment of the invention.

In a second alternative embodiment of the invention, illustrated in FIG. 6, a lower portion 241 of a shell 238 is formed with an annular detent 256 at its lower edge to provide an inwardly extending embossment 257 having a semicircular cross section. A mid-portion of an anchor sleeve 250 is provided with a corresponding annular recess 258 on its outer diameter to receive the surface of embossment 257 in order to provide retention means for retaining the shell to the sleeve. The upper portion of anchor sleeve 250 has an upwardly inwardly tapering outer wall 260 to be received in the lower portion of shell 238. On installation, shell 238 is pressed downwardly along the wall 260 of anchor sleeve 250 until embossment 25 is received in recess 258 to lock shell 238 to the anchor sleeve.

Having disclosed the preferred construction of the invention, it will be recognized that other modifications of the invention can be made without departing from the principles of the invention. For example, circumferential channel 52 and outwardly extending lip 42 may be replaced by suitable adhesive, capable of withstanding the high temperatures of the environment, as a means for retaining the shell to the anchor sleeve. The exclusive rights are intended to be limited only by the scope of the appended claims.

The embodiments of the invention in which an exclusive property or privilege is claimed are defined as follows:

1. A valve seal retainer for retaining a resilient seal element to an internal combustion engine valve, said valve including a valve stem and a valve guide, said valve guide having a wall defining a generally cylindrical outer surface and edge means defining an axially oriented bore therein, said valve stem reciprocatably disposed in said bore, said seal element surrounding said valve stem, said valve seal retainer comprising:

a polymeric sleeve generally surrounding said valve guide wall and including means defining an inner surface having a diameter generally greater than that of said wall;

first retention means for retaining said sleeve to an outer surface of said valve guide wall including a portion of said inner surface configured as an inwardly directed reduced diameter deformable portion that is adapted to be rolled in response to installation of said sleeve on said valve guide in the direction opposite of installation;

a generally tubular shell;

second retention means for retaining a seal element within said shell; and third retention means for retaining said shell to said sleeve.

2. The valve seal retainer in claim 1 in which said sleeve is made from Nylon.

3. The valve seal retainer in claim 1 in which said sleeve is made from Teflon.

4. The valve seal retainer in claim 1 in which said second retention means comprises a wall of said shell having an upper portion formed radially inwardly to form a flange over the seal element and a lower portion being necked down below the seal element to form an inwardly extending seat whereby said valve element is clamped between said flange and seat.

5. The valve seal retainer in claim 4 wherein said retention means further includes a first rigid washer between said seal element and said flange an a second rigid washer between said seal element and said seat.

6. The valve seal retainer in claim 1 in which said first inner surface portion is substantially shorter than the length of said sleeve.

7. The valve seal retainer in claim 6 in which said first inner surface comprises an inwardly directed bead having a generally semicircular surface.

8. The valve seal retainer in claim 6 in which said first inner surface comprises an inwardly rolled, upwardly turned lip.

9. A valve seal retainer for retaining a resilient seal element to an internal combustion engine valve, said valve including a valve stem and a valve guide, said valve guide having a wall defining a generally cylindrical outer surface and edge means defining an axially oriented bore therein, said valve stem reciprocatably disposed in said bore, said seal element surrounding said valve stem, said valve seal retainer comprising:

a polymeric sleeve generally surrounding said valve guide wall and having means defining a first inner surface portion;

first retention means for retaining said sleeve to said valve guide outer surface including said first inner surface portion being dimensioned less than the valve guide outer surface, providing an interference fit between said sleeve inner surface and said valve guide inner surface;

a generally tubular shell;

second retention means for retaining a seal element within said shell;

third retention means for retaining said shell to said sleeve;

said sleeve having means defining a second inner surface greater in diameter than an outer surface of said shell and an inwardly directed recess in said second surface; and said third retention means comprising an outwardly directed lip on said shell outer surface dimensioned for snap-fit retention in said inwardly directed recess.

10. The valve seal retainer in claim 5 in which said first inner surface portion is substantially shorter than the length of said sleeve.

11. The valve seal retainer in claim 10 in which said first inner surface comprises an inwardly directed bead having a generally semicircular surface.

12. The valve seal retainer in claim 10 in which said first inner surface comprises an inwardly rolled, upwardly turned lip.

13. The valve seal retainer in claim 9 in which said sleeve is made from Nylon.

14. The valve seal retainer in claim 9 in which said sleeve is made from Teflon.

15. A valve seal retainer for retaining a resilient seal element to an internal combustion engine valve, said valve including a valve stem and a valve guide, said valve guide having a wall defining a generally cylindrical outer surface and edge means defining an axially oriented bore therein, said valve stem reciprocatably disposed in said bore, said seal element surrounding said valve stem, said valve seal retainer comprising:

a polymeric sleeve generally surrounding said valve guide wall and having means defining a first inner surface portion;

first retention means for retaining said sleeve to said valve guide outer surface including said first inner surface portion being dimensioned less than the valve guide outer surface, providing an interference fit between said sleeve inner surface and said valve guide inner surface;

a generally tubular shell;

second retention means for retaining a seal element within said shell;

third retention means for retaining said shell to said sleeve;

said sleeve having means defining a portion of an outer surface less in diameter than an inner surface of said shell and an outwardly directed recess in said outer surface; and said third retention means comprising an inwardly directed portion of said shell inner surface dimensioned for snap-fit retention in said outwardly directed recess.

16. The valve seal retainer in claim 15 in which said inwardly directed portion comprises an annular detent forming an inwardly extending embossment of semicircular cross section.

17. The valve seal retainer in claim 15 in which said sleeve outer surface has a tapered portion adjacent said outwardly directed recess to guide said inwardly directed portion into said outwardly directed recess.

18. The valve seal retainer in claim 15 in which said first inner surface portion is substantially shorter than the length of said sleeve.

19. The valve seal retainer in claim 18 in which said first inner surface comprises an inwardly directed bead having a generally semicircular surface.

20. The valve seal retainer in claim 18 in which said first inner surface comprises an inwardly rolled, upwardly turned lip.

21. The valve seal retainer in claim 15 in which said sleeve is made from Nylon.

22. The valve seal retainer in claim 15 in which said sleeve is made from Teflon.

23. A valve seal retainer for retaining a resilient seal element to an internal combustion engine valve, said valve including a valve stem and a valve guide, said valve guide having a wall defining a generally cylindrical outer surface and edge means defining an axially oriented bore therein, said valve stem reciprocatably disposed in said bore, said seal element surrounding said valve stem, said valve seal retainer comprising:

a polymeric sleeve generally surrounding and frictionally engaging said valve guide wall providing first retention means for retaining said sleeve to an outer surface of said valve guide wall;

a generally tubular shell surrounding said valve stem and having a length in the axial direction of said stem substantially less than that of said sleeve;

second retention means for retaining a seal element within said shell; and third retention means defined between an upper portion of said sleeve and said shell such that substantially the entire lower portion of said sleeve is free of constraint by said shell, whereby said retainer may accommodate valve guides of large eccentricity.

* * * * *

UNITED STATES PATENT AND TRADEMARK OFFICE

CERTIFICATE OF CORRECTION

PATENT NO. : 4,822,061

DATED : April 18, 1989

INVENTOR(S) : James A. Kammeraad

It is certified that error appears in the above-identified patent and that said Letters Patent is hereby corrected as shown below:

Column 5, line 27:

Delete "25" and insert --257--.

Column 8, line 30:

After "means" insert --for retaining said shell to said sleeve, said third retention means--.

Signed and Sealed this

Twentieth Day of February, 1990

*Attest:*

JEFFREY M. SAMUELS

*Attesting Officer*

*Acting Commissioner of Patents and Trademarks*